United States Patent [19]

Jones

[11] Patent Number: 4,502,412

[45] Date of Patent: Mar. 5, 1985

[54] APPARATUS FOR METERING MARKING PARTICLES ONTO A DEVELOPER ROLLER

[75] Inventor: Thomas B. Jones, Rochester, N.Y.

[73] Assignee: Xerox Corporation, Stamford, Conn.

[21] Appl. No.: 487,479

[22] Filed: Apr. 22, 1983

[51] Int. Cl.[3] ..... G03G 15/09

[52] U.S. Cl. ..... 118/658

[58] Field of Search ..... 118/658; 355/3 DD

[56] References Cited

U.S. PATENT DOCUMENTS 4,292,387 9/1981 Kanbe et al. ..... 430/102

4,297,970 11/1981 Tajima et al. ..... 118/652

FOREIGN PATENT DOCUMENTS 52-113924 8/1977 Japan .

57-2617 7/1983 Japan .

*Primary Examiner*—Bernard D. Pianalto

*Attorney, Agent, or Firm*—H. Fleischer; J. E. Beck; R. Zibelli

[57] ABSTRACT

An apparatus which meters precise quantities of magnetic marking particles onto a developer roller in a magnetic brush development system. An open ended container stores the supply of marking particles therein. A magnetic roller, positioned in the open end of the container, meters marking particles from the open end of the container onto the developer roller of the magnetic brush development system.

10 Claims, 2 Drawing Figures

APPARATUS FOR METERING MARKING PARTICLES ONTO A DEVELOPER ROLLER

This invention relates generally to an electrophotographic printing machine, and more particularly concerns an apparatus for dispensing magnetic marking particles onto a developer roller of a magnetic brush development system.

In general, the process of electrophotographic printing includes charging a photoconductive member to a substantially uniform potential to sensitize the surface thereof. The charged portion of the photoconductive surface is exposed to a light image of an original document being reproduced. Alternatively, a modulated light beam, i.e. a laser beam, may be utilized to discharge selected portions of the charged photoconductive surface to record the desired information thereon. In this way, an electrostatic latent image is recorded on the photoconductive surface which corresponds to the information desired to be reproduced. After recording the electrostatic latent image on the photoconductive member, the latent image is developed by bringing developer material into contact therewith. Generally, the developer material comprises toner particles adhering triboelectrically to carrier granules. The toner particles are attracted from the carrier granules to form a powder image on the photoconductive member which is subsequently transferred to a copy sheet. Finally, the copy sheet is heated to permanently affix the powder image thereto in image configuration.

With the advent of single component development, magnetic toner particles are employed to develop the latent image. Generally, these toner particles are dispensed directly onto the developer roller which, in turn, transports the magnetic toner particles to the latent image recorded on the photoconductive surface. In this way, a single component developer material is employed to develop the latent image. However, it has been found that in attempting to devise high quality electrophotographic printing machines, the utilization of a two-component developer mixture improves copy quality. The disadvantage of utilizing a conventional two-component mixture is that toner particles must be dispensed into the developer material and must be mixed thoroughly to maintain a uniform concentration. It is advantageous to meter a precisely controlled layer of toner particles onto the developer roll. These toner particles adhere triboelectrically to the carrier granules. A system of this type utilizes the best features of a single component development system and a two-component development system. Thus, it is highly desirable, in a two-component development system, to precisely control the metering and mixing of the toner particles within the developer mixture.

Various techniques have been devised for developing electrostatic latent images recorded on a photoconductive surface. The following disclosures appear to be relevant:

U.S. Pat. No. 4,292,387; Patentee: Kanbe et al.; Issued: Sept. 29, 1981.

U.S. Pat. No. 4,297,970; Patentee: Tajima et al.; Issued: Nov. 3, 1981.

Japanese Utility Model Application No. 52-113924; Application Date: Aug. 24, 1977; Applicant: Minolta Camera Company, Ltd.

The pertinent portions of the foregoing disclosures may be briefly summarized as follows:

Kanbe et al. and Tajima et al. disclose a development system with a developer roller positioned in the open end of a container storing a supply of magnetic toner particles. The developer roller advances the magnetic toner particles closely adjacent to the latent image recorded on the photoconductive drum. The developer roller includes a non-magnetic sleeve having a magnet disposed interiorly thereof. A magnetic blade is secured to the container with the free end thereof being spaced from the sleeve of the developer roller. The magnet has a magnetic pole opposed from the blade. This defines a gap between the blade and developer roller through which the magnetic toner particles are transported on the developer roller.

Minolta discloses a development system employing a toner container having a conductive roller disposed in the open end thereof. The conductive roller meters toner particles onto carrier granules on a developer roller. The toner particles adhere triboelectrically to the carrier granules on the developer roller and are transported to the latent image recorded on the photoconductive surface.

In accordance with one aspect of the features of the present invention, there is provided an apparatus for developing a latent image with magnetic marking particles. The apparatus includes means for transporting magnetic carrier granules having the marking particles adhering triboelectrically thereto closely adjacent to the latent image so that the latent image attracts a portion of the marking particles thereto to form a powder image thereof. An open ended container stores a supply of the marking particles therein. Magnetic means, positioned in the open end of the container, meter the magnetic particles from the open end of the container onto the carrier granules on the transporting means.

Pursuant to another aspect of the present invention, there is provided an electrophotographic printing machine of the type having an electrostatic latent image recorded on a photoconductive surface. Means are provided for transporting magnetic carrier granules having marking particles adhering triboelectrically thereto closely adjacent to the latent image so that the latent image attracts a portion of the marking particles thereto to form a powder image thereof. An open ended container stores a supply of the marking particles. Magnetic means, positioned in the open end of the container, meter the magnetic particles from the open end of the container onto the carrier granules on the transporting means.

Pursuant to still another aspect of the present invention, there is provided an apparatus for dispensing magnetic particles onto a magnetic receiving member. An open ended container stores a supply of particles therein. Magnetic means, positioned in the open end of the container, meter particles from the open end of the container onto the receiving member.

Other aspects of the present invention will become apparent as the following description proceeds and upon reference to the drawings, in which:

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
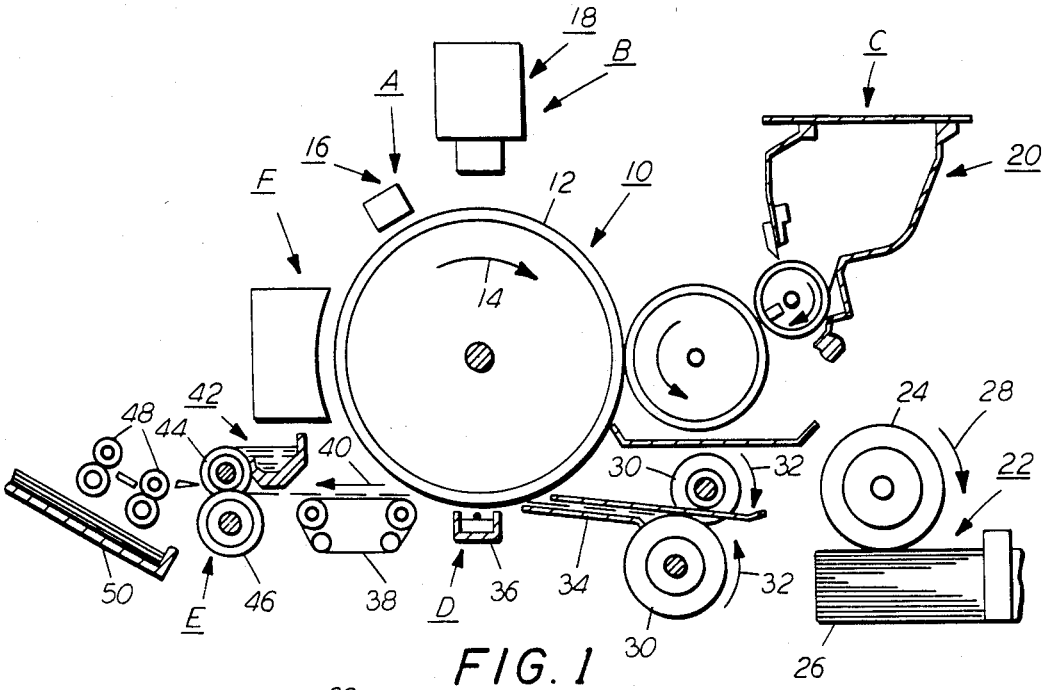
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the apparatus of the present invention therein. It will become evident from the following discussion that this apparatus is equally well suited for use in a wide variety of electrostatographic printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

DETAILED DESCRIPTION OF THE DRAWING

As shown in FIG. 1, the illustrative electrophotographic printing machine employs a drum 10 having a photoconductive surface 12. Preferably, photoconductive surface 12 comprises a selenium alloy deposited on a conductive substrate, such as an aluminum alloy. The conductive substrate is electrically grounded. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high substantially uniform potential.

Next, the charged portion of photoconductive surface 12 is advanced through imaging station B. Imaging station B includes an exposure system, indicated generally by the reference numeral 18. In exposure system 18, an original document is positioned facedown upon a transparent platen. Light rays, reflected from the original document, are transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. One skilled in the art will appreciate that an optical system of the foregoing type need not be the only type of system employed to selectively dissipate the charge on the photoconductive surface. For example, a modulated light beam, such as a laser beam, may be used to irradiate the charged portion of the photoconductive surface to selectively discharge the charge recording the desired information thereon. After the electrostatic latent image is recorded on photoconductive surface 12, drum 10 advances the latent image to development station C.

Figure 2:
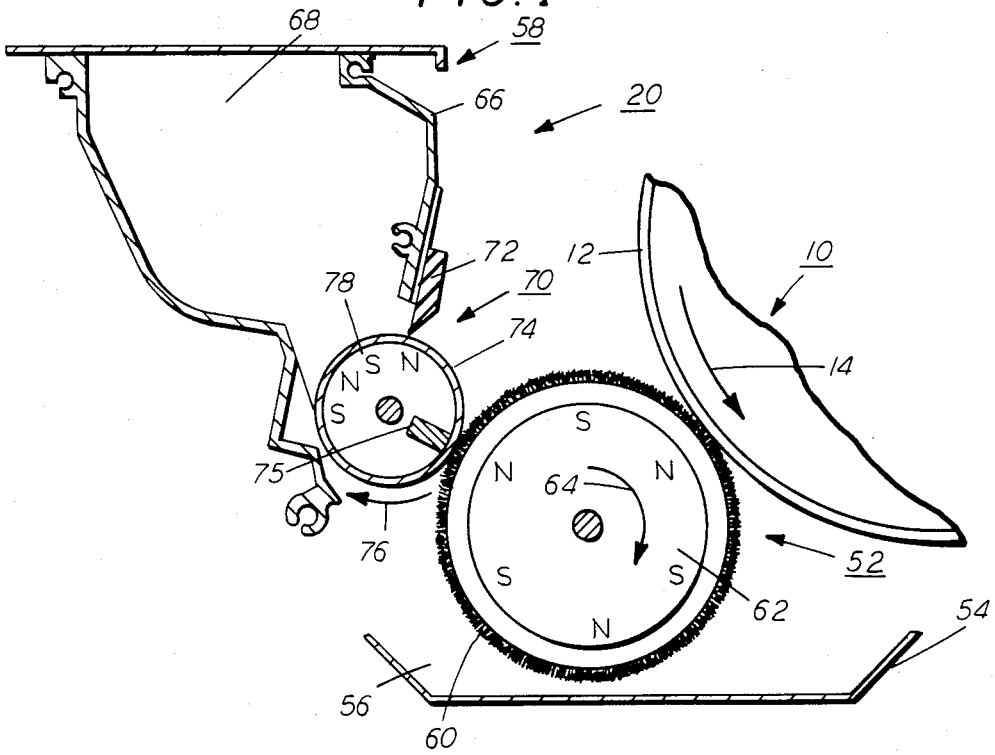
FIG. 2 is an elevational view depicting the development system of the FIG. 1 printing machine having the toner dispenser of the present invention therein.

At development station C, a magnetic brush development system, indicated generally by the reference numeral 20, transports a developer material of magnetic carrier granules having magnetic toner particles adhering triboelectrically thereto into contact with the electrostatic latent image. The latent image attracts the charged toner particles forming a powder image on photoconductive surface 12 of drum 10. As the charged toner particles are attracted to the latent image, the concentration thereof, in the developer material, diminishes. Thus, additional toner particles are furnished from a toner particle dispensing system disposed within development system 20. In this way, the concentration of toner particles on the developer roller advancing the developer material closely adjacent to the photoconductive surface of drum 10 is maintained substantially constant to achieve optimum copy quality. The detailed structure of development system 20 will be described hereinafter with reference to FIG. 2. Drum 10 then advances the toner powder image to transfer station D.

At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of a stack of sheets 26. Feed roll 24 rotates in the direction of arrow 28 so as to advance the uppermost sheet into the nip defined by forwarding rollers 30. Forwarding rollers 30 rotate in the direction of arrow 32 to transport the sheet into chute 34. Chute 34 directs the advancing sheet of support material into contact with photoconductive surface 12 of drum 10 so that the powder image developed thereon contacts the advancing sheet at transfer station D.

Preferably, transfer station D includes a corona generating device 36 which sprays ions onto the backside of the sheet. This attracts the powder image from photoconductive surface 12 to the sheet. After transfer, the sheet continues to move in the direction of arrow 40 onto a conveyor 38 which transports the sheet to fusing station E.

Fusing station E includes a fuser assembly, indicated generally by the reference numeral 42, which permanently affixes the transferred toner powder image to the sheet. Preferably, fuser assembly 42 includes a heated fuser roller 44 and a back-up roller 46. The sheet passes between fuser roller 44 and back-up roller 46 with the powder image contacting fuser roller 44. In this manner, the powder image is permanently affixed to the sheet. After fusing, forwarding rollers 48 advance the sheet to catch tray 50 for subsequent removal from the printing machine by the operator.

It is believed that the foregoing description is sufficient for purposes of the present application to illustrate the general operation of an electrophotographic printing machine incorporating the features of the present invention therein.

Referring now to the specific subject matter of the present invention, the primary components of development system 20 are developer roller 52, housing 54 defining chamber 56 for storing a supply of developer material therein, and toner dispenser 58. In two-component development systems, the concentration of toner particles within the developer material must be maintained within a specified range to insure that the supply of toner particles brought to the development zone is adequate. If an insufficient supply of toner particles is available, then the system is supply limited and development of solid areas in the latent image may suffer. If an excessive amount of toner particles is available, then the background quality of the latent image is reduced or powder clouding may occur. Toner particles must be dispensed so as to maintain the toner particle concentration in the developer material within a prescribed limit. Hereinbefore, in two-component systems, toner particles were dispensed into a sump filled with carrier granules. The resulting material was mixed to produce the two-component developer material. This type of system uses a large volume of carrier granules to accomodate copy to copy fluctuations in toner particle usage. The average concentration of toner particles within the developer material may be higher then necessary for optimal toning of low density images and lower then necessary for optimal toning of high density images. In development system 20, charged toner particles are dispensed by toner dispenser 58 directly onto development roller 52. Developer roller 52 has carrier granules attracted thereto. These additional toner particles are furnished upon demand. In this way, the required inventory of developer material is significantly reduced permitting the rapid response of the development system to variations in requirements for toner particles from copy to copy. Developer roller 52 includes a non-magnetic sleeve 60 having an irregular or roughened exterior surface. Sleeve 60 is journaled for rotation by suitable means such as ball bearing mounts. A shaft assembly is concentrically mounted within sleeve 60 and serves as a fixed mounting for magnet 62. A motor (not shown) rotates sleeve 60 in the direction of arrow 64. As shown, developer roller 62 is positioned closely adjacent to photoconductive surface 12 of drum 10. As sleeve 60 rotates in the direction of arrow 64, it passes through chamber 56 of housing 54. A supply of developer material, i.e. carrier granules having toner particles adhering triboelectrically thereto, is stored in chamber 56. The developer material is attracted by magnet 62 to the exterior circumferential surface of sleeve 60. Next, toner dispenser 58 furnishes additional toner particles to the developer material on sleeve 60. Thereafter, as sleeve 60 continues to rotate in the direction of arrow 64, the developer material is brought closely adjacent to photoconductive surface 12 of drum 10. The electrostatic latent image recorded on photoconductive surface 12 attracts the toner particles from the carrier granules forming a toner powder image thereon. As the toner particles are attracted from the carrier granules, the supply of toner particles on sleeve 60 is diminished. During the next cycle, toner dispenser 58 will once again furnish additional toner particles thereto.

Turning now to a detailed description of toner dispenser 58, toner dispenser 58 includes a hopper 66 defining a chamber 68 for storing a supply of magnetic toner particles therein. Hopper 66 has an open end with dispensing roller 70 positioned thereat. Dispensing roller 70 is also located closely adjacent to developer roller 52. A metering blade 72 is secured to hopper 66 with the free end portion thereof being closely adjacent to dispensing roller 70. Dispensing roller 70 includes a non-magnetic tubular member 74 having the exterior circumferential surface thereof roughened. Tubular member 74 is mounted rotatably on suitable ball bearings. A motor (not shown) rotates tubular member 74 in the direction of arrow 76. Elongated magnet 78 is disposed interiorly of tubular member 74. Magnet 78 is mounted fixedly with a magnetic pole positioned so as to be opposed from metering blade 72. Metering blade 72 is made from a magnetic material. A magnetically soft steel member 75 may be positioned beneath tubular member 74 opposed from developer roller 52. This pole piece, i.e. member 75, concentrates the magnetic flux field to produce a stiff radial brush of developer material bristle, which interact more strongly with the toner particles adhering to tubular member 74. The strong magnetic forces may help to attract the toner particles onto the carrier granules.

By way of example, metering blade 72 may be made from a magnetically soft steel. Both sleeve 60 and tubular member 74 may be made from aluminum with magnets 62 and 78 being made from barium ferrite.

The thickness of the layer of toner particles adhering to tubular member 74 is much thinner than the gap between the free end portion of metering blade 72 and tubular member 74. The concentrated magentic field in the gap between blade 72 and tubular member 74 exerts a strong gradiant force on the magnetic toner particles which holds the toner particles in the gap. Only particles which are highly charged and which adhere tenaciously to the exterior circumferential surface of tubular member 74 can overcome the magnetic force to pass through the gap and travel around tubular member 74. Thus, the metering gap serves a filtering function, restraining insufficiently charged toner particles and preventing their dispensing.

Developer roller 52 is electrically biased to a potential of suitable magnitude and polarity so that the latent image attracts the toner particles from the carrier granules being transported thereon. Furthermore, the electrical bias is selected such that the toner particles on dispensing roller 70 are attracted to developer roller 52. By way of example, the electrical bias may be an AC voltage or an AC voltage superimposed over a DC voltage. The rate at which the toner particles are dispensed onto developer roller 52 by dispensing roller 70 is a function of the rate of rotation of tubular member 74. Thus, a feedback loop may be employed to control the speed of tubular member 74 as a function of the toner particles needed for development. This may be achieved by employing an optica sensor to detect the average optical density of each original as it is scanned and exposed. The electrical output signal from the optical sensor is processed by suitable logic circuitry and employed to control the motor rotating tubular member 74 of dispensing roller 70. In this way, the required amount of toner particles for each original document being developed may be transported to developer roller 52 on dispensing roll 70.

In operation, sleeve 60 is covered with magnetic carrier granules and magnetic toner particles. As sleeve 60 rotates in the direction of arrow 64, the developer material is advanced closely adjacent to the latent image recorded on photoconductive surface 12 of drum 10. The toner particles are attracted from the carrier granules forming a toner powder image thereon. Sleeve 60 passes through chamber 56 of housing 54. Chamber 56 stores a small supply of developer material therein. In addition, a doctor blade (not shown) may be located immediately thereafter to remove or trim any excessive material from developer roller 52. Additional toner particles are being continuously dispensed onto developer roller 52. Dispensing roller 70 includes a tubular member 74 which has a thin layer of toner particles adhering thereto. The layer of developer material on developer roller 52 contacts the toner particles on dispensing roll 70. The developer material on developer roller 52 attracts the toner particles on dispensing roll 70 which have already been triboelectrically charged by frictional contact with dispensing roll 70. A piece of magnetically soft steel may be positioned under tubular member 74 to produce a stiff radial brush of developer bristles which interacts more strongly with the toner particles adhering to tubular member 74. The strong magnetic forces may help to attract the toner particles onto the carrier granules. However, the electrical bias applied to the developer roller 52 is primarily used to detach the toner particles from dispensing roller 70. The rate at which the toner particles are dispensed is determined by the angular velocity of tubular member 74.

One skilled in the art will appreciate that although toner particles are shown as being metered on the developer roller before development of the electrostatic latent image, the toner dispenser may be positioned such that the toner particles are metered onto the developer roller after development.

In recapitulation, it is clear that the apparatus of the present invention meters a precise quantity of magnetic toner particles onto the developer material adhering to the developer roller. In this way, only a small supply of developer material is required to be stored in the chamber of the housing and the concentration of toner particles within the developer material may be readily optimized to maintain copy quality.

It is, therefore, evident that there has been provided in accordance with the present invention, an apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image with magnetic marking particles, including:

a developer roller for transporting magnetic carrier granules having the marking particles adhering triboelectrically thereto closely adjacent to the latent image so that the latent image attracts a portion of the marking particles thereto to form a powder image thereof;

an open ended container storing a supply of the marking particles therein;

a magnetic metering roller, positioned in the open end of said container, for dispensing the marking particles from the open end of said container onto the carrier granules on said developer roller; and means for regulating the thickness of the layer of marking particles adhering to said metering roller.

2. An apparatus according to claim 1, wherein said metering roller includes:

a non-magnetic tubular member; and an elongated magnet positioned interiorly of and spaced from said tubular member.

3. An apparatus according to claim 2, wherein said regulating means includes a magnetic trim blade mounted on said container and positioned to have the free end portion thereof adjacent said tubular member to define a gap therebetween.

4. An apparatus according to claim 3, wherein:

said tubular member is mounted rotatably; and said elongated magnet is mounted stationarily and oriented to have a magnetic pole opposed from said trim blade so that the layer of marking particles adhering to said tubular member is less than the gap therebetween.

5. An apparatus according to claim 4, wherein said developer roller includes:

a non-magnetic sleeve positioned closely adjacent to said tubular member; and a magnetic member disposed interiorly of said sleeve and spaced therefrom to attract the carrier granules having the marking particles adhering triboelectrically thereto to said sleeve for transportation to the latent image.

6. An electrophotographic printing machine of the type having an electrostatic latent image recorded on a photoconductive surface, including:

a developer roller for transporting magnetic carrier granules having magnetic toner particles adhering triboelectrically thereto closely adjacent to the latent image so that the latent image attracts a portion of the toner particles thereto to form a powder image thereof;

an open ended container storing a supply of the toner particles therein;

a magnetic metering roller, positioned in the open end of said container, for dispensing the toner particles from the open end of said container onto the carrier granules on said developer roller; and means for regulating the thickness of the layer of toner particles adhering to said metering roller.

7. A printing machine according to claim 6, wherein said metering roller includes:

a non-magnetic tubular member; and an elongated magnet positioned interiorly of and spaced from said tubular member.

8. A printing machine according to claim 7, wherein said regulating means includes a magnetic trim blade mounted on said container and positioned to have the free end portion thereof adjacent said tubular member to define a gap therebetween.

9. A printing machine according to claim 8, wherein:

said tubular member is mounted rotatably; and said elongated magnet is mounted stationarily and oriented to have a magnetic pole opposed from said trim blade so that the layer of toner particles adhering to said tubular member is less than the gap therebetween.

10. A printing machine according to claim 9, wherein said developer roller includes:

a non-magnetic sleeve positioned closely adjacent to said tubular member; and a magentic member disposed interiorly of said sleeve and spaced therefrom to attract the carrier granules having the toner particles adhering triboelectrically thereto to said sleeve for transportation to the latent image.

* * * * *